United States Patent [19]

Dollenmayer

[11] Patent Number: 4,557,192

[45] Date of Patent: Dec. 10, 1985

[54] SELF RESTORING PIVOTING MEANS AND PRINT HAMMER USING SAME

[75] Inventor: William L. Dollenmayer, Versailles, Ky.

[73] Assignee: International Business Machines Corporation, Armonk, N.Y.

[21] Appl. No.: 266,789

[22] Filed: May 26, 1981

[51] Int. Cl.[4] ..... B41J 9/127

[52] U.S. Cl. ..... 101/93.48; 101/93.34; 400/144.2; 400/157.2; 267/154

[58] Field of Search ..... 101/93.48, 93.33, 93.34; 400/157.1, 157.2, 157.3, 441, 143, 144, 144.1, 144.2, 144.3; 267/154, 148, 151; 29/173

[56] References Cited

U.S. PATENT DOCUMENTS

| | | | |
|---|---|---|---|
| 2,906,522 | 9/1959 | Wagner | 267/154 |
| 3,110,250 | 11/1963 | Fradkin | 400/157.2 X |
| 3,276,762 | 10/1966 | Thomas | 267/154 |
| 3,384,216 | 5/1968 | Thayer | 400/157.2 X |
| 3,442,365 | 5/1969 | Ragland, III et al. | 400/157.2 X |
| 3,504,623 | 4/1970 | Staller | 101/93 |
| 3,631,797 | 1/1972 | Johnston et al. | 101/93.48 |
| 3,670,647 | 6/1972 | Funk et al. | 400/167 X |
| 3,968,744 | 7/1976 | Kasu et al. | 101/93.48 X |
| 4,167,343 | 9/1979 | Golobay | 400/124 |

FOREIGN PATENT DOCUMENTS

| | | | |
|---|---|---|---|
| 2717686 | 11/1977 | Fed. Rep. of Germany | 267/151 |
| 993833 | 6/1965 | United Kingdom | 101/93.48 |

OTHER PUBLICATIONS

IBM Technical Disclosure Bulletin, vol. 19, No. 2, Jul. 1976, pp. 443-444, "Print Impression Control Device", J. E. Drejza.

*Primary Examiner*—Edgar S. Burr
*Assistant Examiner*—Charles A. Pearson
*Attorney, Agent, or Firm*—Laurence R. Letson

[57] ABSTRACT

A pivoting means for pivoting back and forth a mechanical load such as a print hammer about a given axis and within a low amplitude angle includes two elongated leaf springs. The leaf springs are located in planes at a given angle with respect to each other but both planes being perpendicular to the plane of pivotation of the mechanical load. A frame fixed relative to the pivotable mechanical load is used for attaching the extremities of both elongated leaf springs. The mechanical load is attached to both leaf springs equidistant from their attached extremities. A power source pivots the mechanical load from its rest position to its work or print position causing the two leaf springs to be flexed in torsion. The torsion flexing generates a return torque for self restoring the mechanical load back to its original position.

5 Claims, 2 Drawing Figures

SELF RESTORING PIVOTING MEANS AND PRINT HAMMER USING SAME

BRIEF BACKGROUND OF THE INVENTION

1. Field

This invention relates to pivoting means with a self restoring capability particularly suitable for being used in a low cost pivoting print hammer.

2. Description of the Prior Art

A number of apparatuses need low amplitude pivoting means for repetitively pivoting a mechanical load from a given rest position to a given work position and back, with external energy being used to pivot the mechanical load in one direction only, while the pivoting means, provided with self restoring capability, brings the mechanical load back to its rest position upon removal of the external energy. For instance, impact printing is performed by selectively striking a character bearing print element against a print ribbon and a recording medium held by a platen using a pivoting print hammer. The print hammer includes a mechanical load, made of a hammer head attached to a power arm which is pivoted from a rest position to an impact print position for striking a selected character of the print element. A subsequent print operation may then be performed after the hammer head and power arm are returned back to their rest position. The involved pivot for the hammer head and power arm may include a shaft and bearing arrangement which has inherent mechanical clearances and suffers from progressive wear due to the large number of pivotal movements to be achieved during the printer life. The application of lubrication to increase the bearing life is a troublesome, time consuming and costly operation.

Elimination of bearing wear and lubrication requirements has been made possible by resiliently mounting the power arm and hammer head of a printer. U.S. Pat. No. 3,504,623 to K. J. Staller shows such a device wherein a power arm and hammer head arrangement is mounted to a frame by means of two leaf springs. These leaf springs are mounted parallel to each other with one extremity of each of the leaf springs being connected to the frame and the other being connected to the power arm and hammer head arrangement. The power arm and hammer head arrangement is thus made movable from its rest position to an impact print position and back, by transversely flexing the leaf springs and moving their longitudinal axes in a plane parallel to the plane of motion of said power arm and hammer head arrangement. Such a system suffers from three main drawbacks. First, a very efficient additional dampening system must be provided in order to avoid any undesirable oscillations about the rest position of the power arm and hammer head arrangement upon its return from the impact print position. High speed printing performances are then questionable. Second, only limited lateral rigidity can be achieved with this arrangement resulting in undesirable torsional effects occurring within the springs. This leads to low quality printing due to the hammer head missing its target, i.e. the center of gravity of the selected character bearing print element. Third, the large bending displacements of the springs tend to excite the higher modes of vibrations of the springs resulting in premature fatigue failures.

SUMMARY

In order to overcome the above noted shortcomings of the prior art, the pivoting means of this invention includes a leaf spring arrangement in which two leaf spring portions secured at their ends and having the mechanical load secured thereto intermediate the ends thereof are flexed in torsion as the load is moved through a low amplitude angle to its work position and thereafter effect the return of the mechanical load using the return torque of both leaf spring portions. The two leaf spring portions preferably include two separate leaf springs located at right angles to each other and located perpendicular to the plane of motion of the mechanical load. The leaf spring arrangement provides a high degree of lateral stiffness to the plane of motion resulting in high quality printing. The low amplitude angle of motion reduces fatigue resulting in long life. Further, contamination occasioned by the ambiance has little negative effect and can actually effect improvement in the systems operation. Accordingly, one object of the invention is to provide a bearingless pivoting means free of lubrication problems. Another object of the invention is to provide a low amplitude self restoring pivoting means having lateral rigidity. A still further object of the invention is to provide a low cost bearingless print hammer mechanism for a printer.

The foregoing and other features and advantages of this invention will be apparent from the following more particular description of the preferred embodiment of the invention as illustrated in the accompanying drawing.

DETAILED DESCRIPTION OF THE INVENTION

Figures 1, 2:
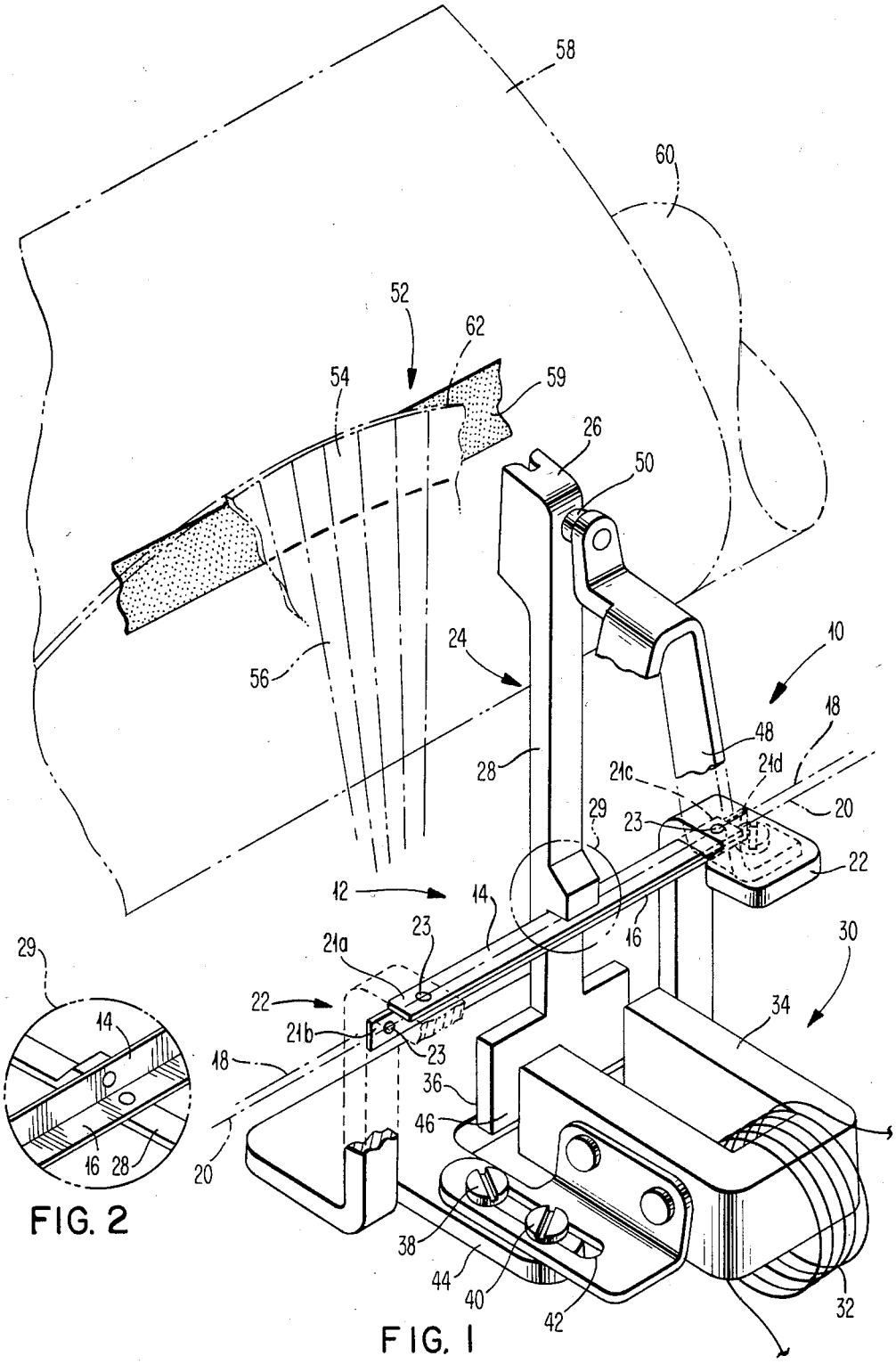
FIG. 1 represents a pivotable print hammer using the pivoting means of this invention.
FIG. 2 is an enlarged view of a portion of FIG. 1.

With reference to the figures, a perspective view of a print hammer 10 incorporating the pivoting means 12 of this invention is represented in its rest position. The pivoting means 12 includes two elongated leaf springs 14 and 16 mounted substantially perpendicular to each other, with their longitudinal axes 18 and 20 parallel to each other. The leaf springs 14 and 16 are attached at their end portions or extremities 21*a*, 21*b*, 21*c*, 21*d* to a relatively fixed frame 22, by means of rivets 23 or other means of fixation. The mechanical load 24 to be made pivotable about the pivoting means 12 includes a hammer head 26 connected to an elongated power arm 28. The power arm 28 is fixedly attached to both leaf springs 14 and 16 as shown at 29 at locations thereon substantially equidistant from the attached extremities 21*a*, 21*b* and 21*c*, 21*d*. The two leaf springs 14 and 16 may also be molded into the power arm 28. In operation, the power arm 28 has to be repetitively pivoted back and forth in a plane of motion perpendicular to the longitudinal axes 18 and 20 of both leaf springs 14 and 16, within a low amplitude angle, between a rest position as depicted and a given work, i.e. print, position to be subsequently defined.

The actuating means for pivoting the mechanical load 24 in a forward direction, i.e. from its rest position to its print position, includes an electro magnet 30 having a coil 32 wound about a magnet yoke 34. A magnet clapper 36 is attached to the end of the power arm 28 opposite the hammer head 26. The magnet clapper 36 is an extension molded with the power arm 28 and hammer head 26 arrangement and therefore also a part of the mechanical load 24. The magnet yoke 34 is connected to the frame 22 by means of two screws 38 and 40 on the side of the magnet yoke 34. A slot 42 enables sliding the magnet yoke 34 along the base plate 44 of the frame 22 to adjust the air gap 46 between the magnet yoke 34 and the magnet clapper 36.

A separate backstop support 48 is attached to the frame 22. The backstop support 48 is provided with a resilient backstop element 50 to dampen the oscillations of the mechanical load 24 upon its return from its print position to rest position and helps to hold the mechanical load 24 in its rest position.

A typefont carrying means, e.g. a printwheel 52 including character bearing print elements 54 held by resilient printwheel spokes 56 is interposed between the hammer head 26 and a recording medium (sheet of paper) 58 held by a cylindrical platen 60. A print ribbon 59 is also interposed between the printwheel 52 and the recording medium 58. Each character printing operation is performed by conventionally rotating the printwheel 52 to bring a selected print element 54 in front of the hammer head 26 and then operating the actuating means, i.e. the electro magnet 30, by energizing the coil 32. The magnet clapper 36 is then attracted toward the magnet yoke 34, which in turn generates a torque on the pivoting means 12 thereby flexing the two leaf springs 14 and 16 in torsion to produce a bearing effect and rotate the mechanical load 24. The mechanical load 24 is rotated in a plane of motion perpendicular to the platen 60 axis and about an instantaneous pivot axis substantially located at the intersection of the planes of the leaf springs 14 and 16. More precisely, the hammer head 26 is made to pivot forwardly in said plane of motion toward the platen 60, through a relatively low amplitude angle (e.g. 10°) and strike the selected print element 54 against the print ribbon 59 and recording medium 58 wherein a character is printed. The latter position of the hammer head 26, and therefore of the whole mechanical load 24, is designated as the work position or impact print position. At or slightly before the impact print position is reached, the electrical impulse to the coil 32 is turned-off, which releases the magnet clapper 36 from being attracted by the electro magnet 30. A return torque produced by the resilient flexing in torsion of leaf springs 14 and 16 pivots the mechanical load 24 back toward its rest position, i.e. against the backstop element 50. The pivoting means 12 of this invention is thus provided with a self restoring force for restoring the power arm 28 back from its print impact position to its rest position.

By having the two leaf springs 14 and 16 at substantially a right angle to each other and disposed as depicted in the figure, high lateral rigidity is provided. In other words, vertical rigidity, i.e. counteracting the mechanical load 24 weight is provided by the leaf spring 16 being in a vertical plane perpendicular to the plane of motion of the power arm 28 with the longitudinal axis 20 of the leaf spring 16 being perpendicular to the plane of motion. Horizontal rigidity, i.e. parallel to the plane of motion of the mechanical load 24 about pivoting means 12, is provided by leaf spring 14 being located in a horizontal plane with its longitudinal axis 18 being perpendicular to the plane of motion.

The pivoting means 12 thus behaves as a conventional pivot shaft and bearing arrangement, without bearing lubrication and wear problems. By also attaching the mechanical load 24 at substantially the middle location of the pivoting means 12, i.e. equidistant from the extremities 21*a*, 21*b* and 21*c*, 21*d* of leaf springs 14 and 16 fixed to the frame 22, the mechanical torsional deformations are symmetrically distributed within botth leaf springs 14 and 16 on both sides of the points of fixation of the mechanical load 24 to the pivoting means 12. Accordingly, the pivoting means are also made stable, with the plane of motion (rotation) of the mechanical load 24 being fixed relativve to the frame 22. Poor printing, due to undesirable lateral movement of the hammer head 26 out of the plane of motion, is thus avoided.

Upon removal of the electro magnetic energy attracting the magnet clapper 36, the mechanical load 24 is submitted to a return torque provided by the two leaf springs 14 and 16 flexed in torsion. The mechanical load 24 is thus self restored from its work (print) position to its rest position. The resilient effect of the leaf springs 14 and 16 would normally cause oscillations of the mechanical load 24 about its rest position and no subsequent print operation would be possible until oscillations of the mechanical load 24 have been sufficiently dampened to a given minimal amplitude. The resilient backstop element 50 helps in dampening such oscillations. In addition the presence of the normal dirt and ribbon ink on the leaf springs 14 and 16 provides inherent dampening that improves printing performance. Also, additional dampening of the mechanical load 24 oscillations may be provided by coating the two leaf springs 14 and 16 with an elastomer compound.

While the pivoting means 12 has been described as including two separate leaf springs 14 and 16, it is recognized by those skilled in the art that a single piece of spring steel bent along its longitudinal axis to thereby form two orthogonally positioned members could be substituted for the two separate members. Further, one may deviate from precise right angle positions of the leaf springs with a resultant lessening of bending stiffness. Additionally, when using two separate members, if one member is made wider than the other, more bending stiffness is created in one plane than the other. Thus, a larger vertical leaf spring 16 would be used to support a heavy load while a larger horizontal leaf spring 14 would be used if more precise print registration were desired.

While the invention has been particularly shown and described with reference to the preferred embodiment thereof, it will be understood by those skilled in the art that the foregoing and other changes in form and details may be made therein without departing from the spirit and scope of the invention.

What is claimed is:

1. In a printer comprising a platen for supporting a recording medium, typefont carrying means, a print ribbon interposed between said typefont carrying means and recording medium, a hammer head connected to a power arm pivotable in a vertical plane of motion from a rest position wherein said power arm is substantially vertically aligned to a print position to strike a character bearing print element of said typefont carrying means against said print ribbon and recording medium, pivoting means for pivoting said pivotable power arm including:

a frame fixed relative to said pivotable power arm;

a first elongated leaf spring located in a vertical plane perpendicular to said plane of motion with the longitudinal axis of said first leaf spring being horizontal and said first leaf spring having both extremities attached to said frame;

a second elongated leaf spring located in a horizontal plane with its longitudinal axis being parallel to the longitudinal axis of said first leaf spring and having both of its extremities attached to said frame;

said first and said second elongated leaf springs being connected to and supporting said power arm;

actuating means for supplying a substantially horizontal force to said power arm for pivoting said power arm in said plane of motion from said rest position to said print position whereby said power arm flexes said first and second leaf springs in torsion; and, restoring means for pivoting said power arm back to said rest position using the return torque of said leaf springs flexed in torsion.

2. In a printer according to claim 1, the pivoting means being further characterized in that said actuating means include:

an energizable electro magnet having a magnet yoke and a coil wound about said magnet yoke;

means for attaching said magnet yoke to said frame; and, a magnet clapper attached to said power arm; wherein energization of the electro magnet attracting said magnet clapper to said magnet yoke and thereby rotating said power arm from said rest position to said print position thereby flexing the elongated leaf springs in torsion.

3. In a printer according to claim 2, the pivoting means being further characterized in that said means for attaching said magnet yoke to said frame includes means for adjusting the air gap between said magnet yoke and clapper by slidingly moving the magnet yoke relative to the frame.

4. In a printer according to claim 3, the pivoting means being further characterized in that said restoring means for pivoting the power arm back to rest position includes:

a backstop support connected to said frame;

a resilient backstop element attached to said backstop support, wherein removal of energization of said electro magnet allows the return torque exerted on the power arm by said two elongated leaf springs flexed in torsion to bring the hammer head against the backstop element which resiliently dampens the oscillations of the power arm and hammer head about said rest position.

5. In a printer according to claim 1 the pivoting means being further characterized in that at least one of said elongated leaf springs is coated with an elastomer compound.

* * * * *